United States Patent [19]

Wang

[11] Patent Number: 5,069,152

[45] Date of Patent: Dec. 3, 1991

[54] DIFFERENTIAL FEEDING APPARATUS FOR A SEWING MACHINE

[76] Inventor: Shui-Nu Wang, No. 6, Nan Pin Road, Taichung, Taiwan

[21] Appl. No.: 654,244

[22] Filed: Feb. 12, 1991

[51] Int. Cl.[5] ..... D05B 27/08

[52] U.S. Cl. ..... 112/313; 112/314

[58] Field of Search ..... 112/303, 312, 313, 314

[56] References Cited

U.S. PATENT DOCUMENTS

| | | | |
|---|---|---|---|
| 3,450,079 | 6/1969 | Lukin | 112/313 |
| 3,611,817 | 10/1971 | Smith et al. | 112/313 |
| 4,436,045 | 3/1984 | Bonham et al. | 112/313 |
| 4,674,426 | 6/1987 | Kasuda et al. | 112/313 |

*Primary Examiner*—Werner H. Schroeder
*Assistant Examiner*—Paul C. Lewis

[57] ABSTRACT

A feeding apparatus includes a spindle and a shaft disposed in a base of a sewing machine. A lever is fixed on the shaft and can be caused to swing by the spindle. Two followers are engaged on the spindle. A pawl is fixed on each follower for feeding cloth. One follower is coupled to one end of the lever and the other follower is coupled to the other end of the lever by a link and a lever arm. The amplitude of swinging of the lever arm can be changed so that one of the pawls can be caused to move back and forth relative to the other pawl.

5 Claims, 6 Drawing Sheets

DIFFERENTIAL FEEDING APPARATUS FOR A SEWING MACHINE

BACKGROUND OF THE INVENTION (a) Field of the Invention

The present invention relates to a differential feeding apparatus, and more particularly to a differential feeding apparatus for a sewing machine.

(b) Description of the Prior Art

A feeding apparatus is generally provided in a sewing machine for feeding forward a cloth which is to be sewed by the sewing machine. The cloth is generally fed forward smoothly and flatly. However, when it is required to form wrinkles in the cloth, it is usually first required to form wrinkle portions manually in the cloth and then the wrinkle portions should be carefully handled and pressed by hands during sewing operations so that the wrinkles can be formed. The sewing operations are difficult and time consuming. In addition, when it is required to sew or to stitch elastic cloth or elastic article, such as an elastic band, it is usually first required to stretch and to protract the elastic article manually and then maintain the stretch status during sewing operations so that the elastic article can be sewed. The sewing operations are also difficult and very inconvenient.

The present invention has arisen to mitigate and/or obviate the afore-described disadvantages of the conventional sewing machines.

SUMMARY OF THE INVENTION

The primary object of the present invention is to provide a differential feeding apparatus for a sewing machine in which the cloth can be fed differentially so that wrinkles can be easily formed in the cloth and so that elastic articles can be easily sewed.

In accordance with one aspect of the present invention, there is provided a differential feeding apparatus which is disposed in a base of a sewing machine and which includes a shaft caused to swing by a spindle. A lever is fixed on the shaft. A cam is fixed on the spindle and is engaged in two followers for causing the followers to move up and down. A pawl is fixed on each of the followers. One of the followers is pivotally coupled to one end of the lever so that the follower is caused to move back and forth by swinging movement of the lever. One end of a link is pivotally coupled to the other end of the lever. The other end of the link has a block slidably received in a groove formed in a lower portion of a second lever. The other follower is coupled to the upper end of the second lever so that the other follower can be caused to move back and forth by swinging movement of the second lever. When the block is caused to move up and down along the groove of the second lever, the distance between the block and the pivot axle of the second lever can be changed so that the amplitude of the upper end of the second lever can be adjusted and so that one pawl can be caused to move back and forth relative to the other pawl.

Further objectives and advantages of the present invention will become apparent from a careful reading of the detailed description provided hereinbelow, with appropriate reference to the accompanying drawings.

DETAILED DESCRIPTION OF THE INVENTION

Figure 1:
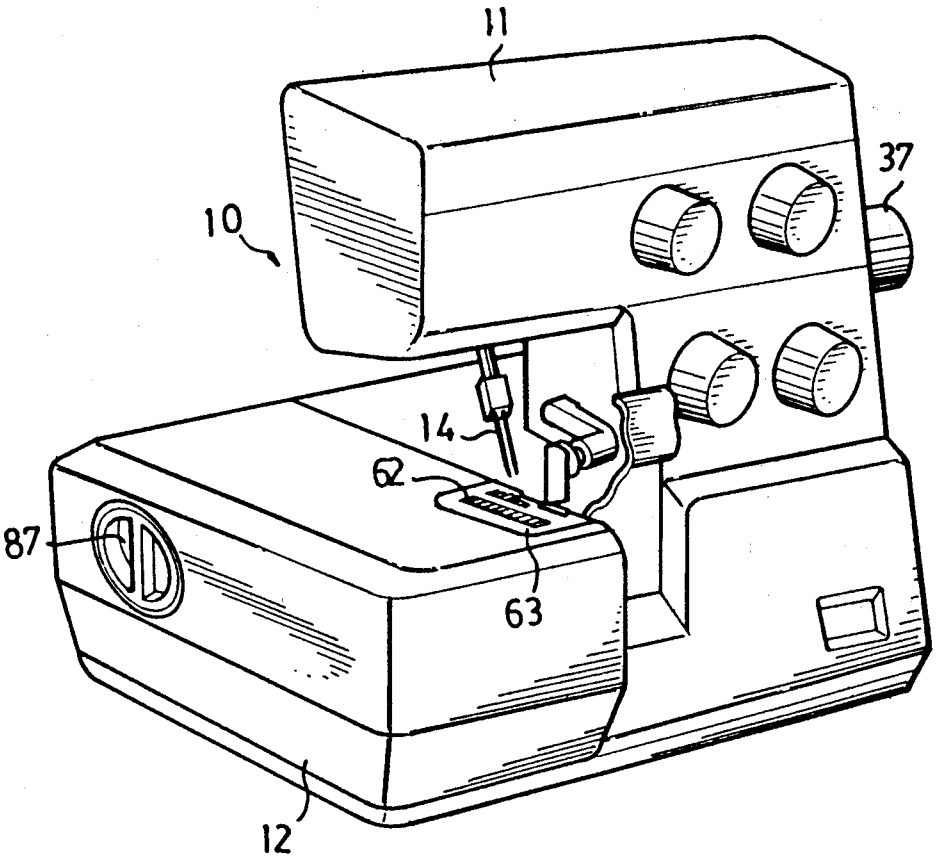
FIG. 1 is a perspective view of a sewing machine.

Referring to the drawings and initially to FIG. 1, a sewing machine 10 generally comprises a cantilever beam 11 disposed on a base 12 and a needle 14 provided at the free end portion of the cantilever beam 11 for conducting sewing operations. A differential feeding apparatus in accordance with the present invention is disposed in the sewing machine 10 for feeding the cloth to be sewed differentially.

Figure 2:
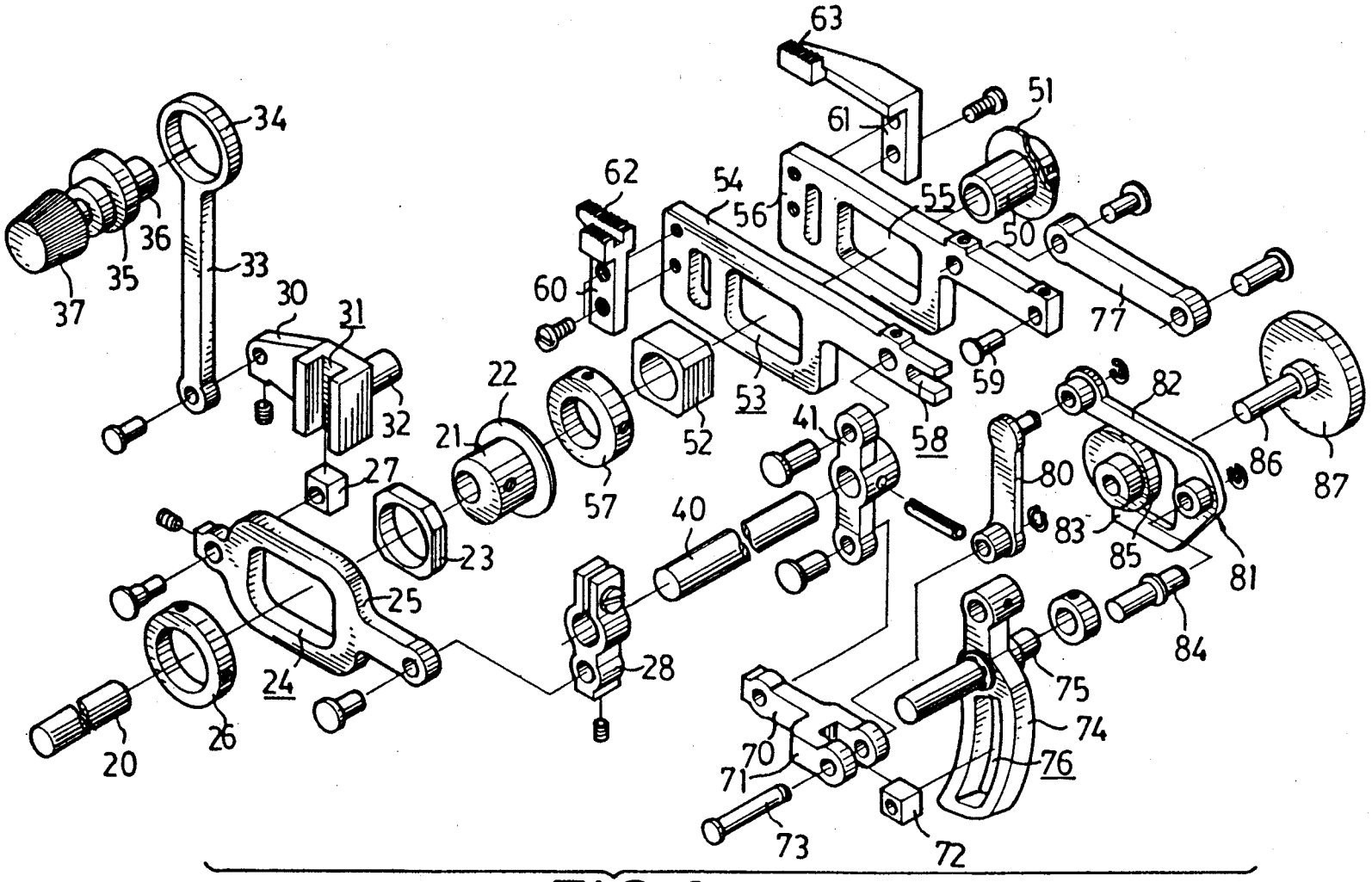
FIG. 2 is an exploded view of the differential feeding apparatus in accordance with the present invention.
Figure 3:
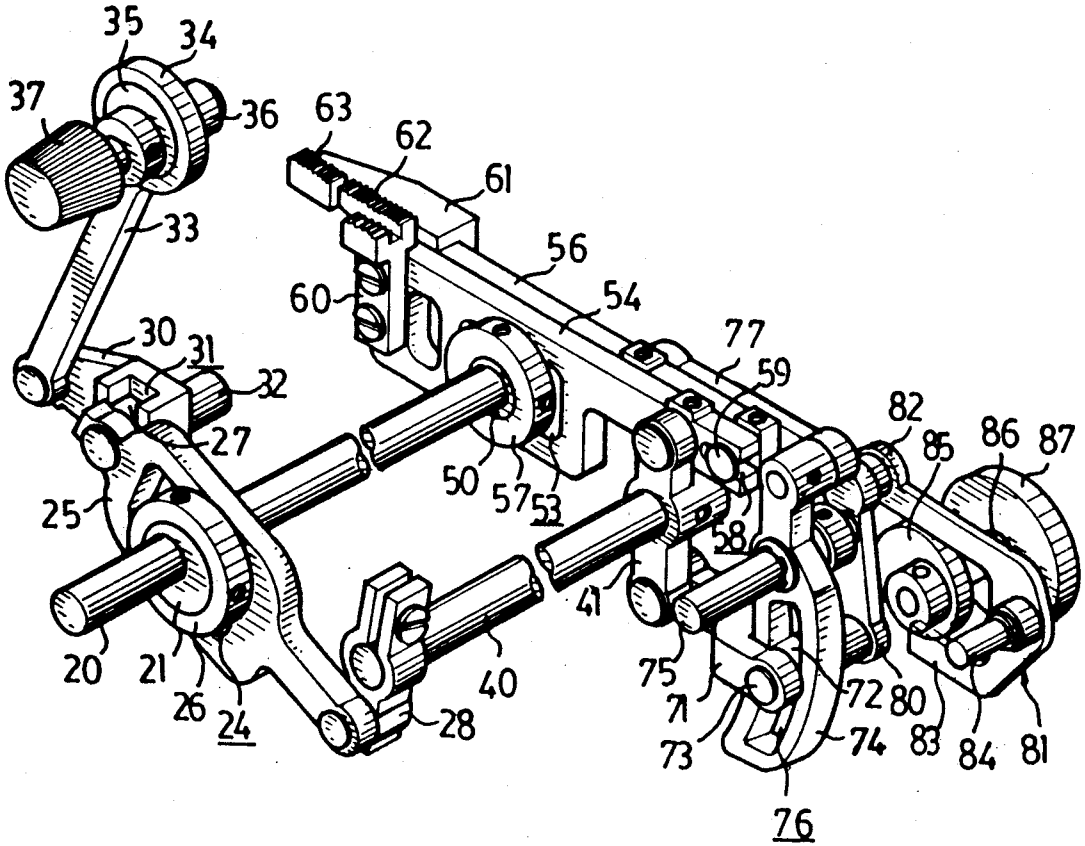
FIG. 3 is a perspective view of the differential feeding apparatus.

Referring next to FIGS. 2 and 3, the differential feeding apparatus comprises generally a driving spindle 20 and a shaft 40 rotatably supported in parallel in the base 12 of the sewing machine 10. A cam 21 is fixed on one end of the driving spindle 20 and rotates in concert with the driving spindle 20. An annular flange 22 is integrally formed on one end of the cam 21. A guide 23 which has a substantially square outer shape is rotatably engaged on the cam 21 and is slidably received in a rectangular opening 24 of a follower 25. A ring 26 is fixed on the other end of the cam 21 so that the guide 23 is guided to slide along the rectangular opening 24 of the follower 25 and so that the follower 25 can be caused to move relatively up and down by rotation of the cam 21 and the spindle 20.

A block 27 is pivotally coupled to one end of the follower 25, and the other end of the follower 25 is pivotally coupled to a lower end of a lever 28 which has a middle portion fixed to one end of the shaft 40. The lever 28 can be caused to swing about the axis of the shaft 40 by the follower 25. A middle portion of another lever 41 is fixed on the other end of the shaft 40. The block 27 is guided to slide along a slot 31 formed in one end of a plate 30, this end of the plate 30 is pivotally supported in the base 12 of the machine 10 by a stub 32. The other end of the plate 30 is pivotally coupled to a lower end of an arm 33 which has a ring portion 34 formed on the upper end thereof. A cam 35 is fixed on an axle 36 which is rotatably supported in the base 12 of the machine 10, and is received in the ring portion 34 in a sliding engagement so that the arm 33 can be caused to move up and down by rotation of the cam 35 and the axle 36. The plate 30 is thus caused to rotate about the stub 32 so that the longitudinal axis 38 (FIGS. 4 and 5) of the slot 31 is also caused to rotate about the stub 32. A knob 37 is fixed on one end of the axle 36 and is located outside of the base 12 (FIG. 1).

A cam 50 is fixed on the other end of the driving spindle 20 opposite to the cam 21 and rotates in concert with the driving spindle 20. An annular flange 51 is integrally formed on one end of the cam 50. A guide 52 which has a substantially square outer shape is rotatably engaged on the cam 50 and is slidably received in both rectangular openings 53, 55 of two followers 54, 56. A ring 57 is fixed on the other end of the cam 50 so that the guide 52 is guided to slide along the rectangular openings 53, 55 of the followers 54, 56 and so that both followers 54, 56 can be caused to move up and down simultaneously by rotation of the cam 50 and the spindle 20. A notch 58 is formed in a rear end of the follower 54. A pin 59 is fixed to a rear end of the follower 56 and is slidably received in the notch 58 of the follower 54 so that the followers 54 and 56 can be guided to move forward and backward relative to each other by the sliding engagements between the guide 52 and the openings 53, 55 and between the pin 59 and the notch 58.

A support 60, 61 is fixed to the front end of each of the followers 54, 56. A pawl 62, 63 is formed on the upper end of each of the supports 60, 61. The pawls 62, 63 are aligned so that the pawls 62, 63 can be caused to move forward and backward relative to each other when the followers 54, 56 move forward and backward relative to each other. The upper end of the lever 41 is pivotally coupled to the rear end of the follower 54 so that the follower 54 can be caused to move back and forth by the swinging movement of the lever 41.

Figure 5:
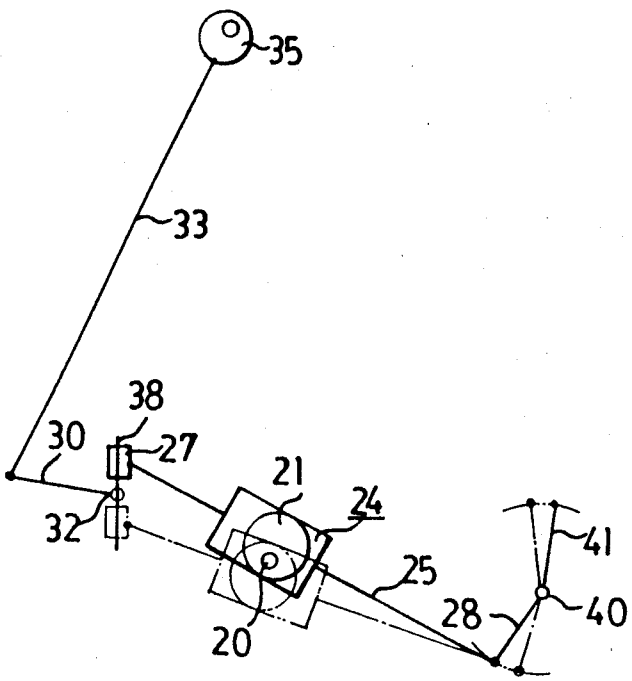
FIGS. 4 and 5 are schematic views illustrating the adjustment of a feeding stroke of the differential feeding apparatus.
Figure 4:
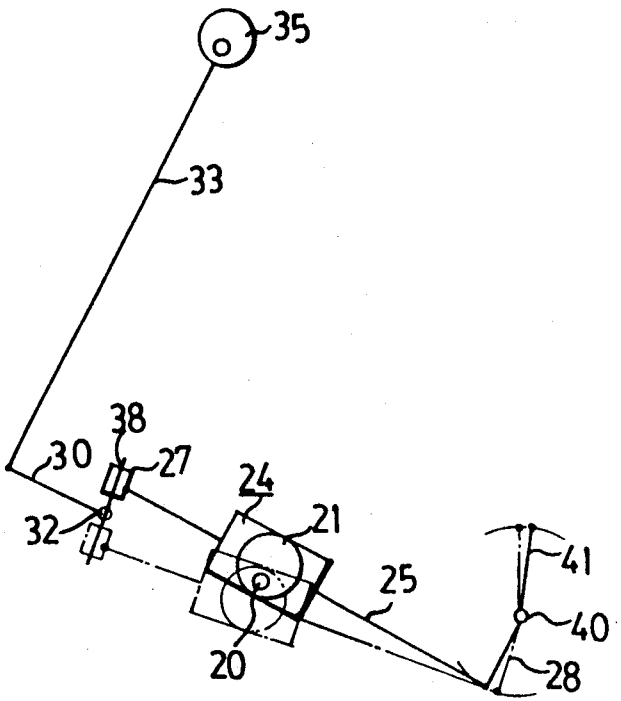

Referring next to FIGS. 4 and 5, when the arm 33 is caused to move up and down by the cam 35 so that the longitudinal axis 38 of the slot 31 is also caused to rotate about the axis of the stub 32, and when the middle portion of the follower 25 is caused to move up and down by the cam 21, the amplitude of swinging of the lever 28 can be changed so that the amplitude of swinging of the lever 41 can also be changed. The amplitude of swinging of the lever 41 is related to the displacement of the pawls 62, 63 which is related to the feeding stroke of the feeding apparatus.

Referring again to FIGS. 2 and 3, the front end of a link 70 is pivotally coupled to the lower end of the lever 41. A fork 71 is integrally formed on the rear end of the link 70. A block 72 is pivotally supported between the limbs of the fork 71 by a pin 73. A middle portion of a lever 74 is fixed to an axle 75 which is rotatably supported in the base 12 so that the lever 74 is rotatable about the axis of the axle 75. A groove 76 is formed in the lower portion of the lever 74 for slidably receiving the block 72 so that the lever 74 can be caused to swing by the swinging movement of the lever 41. A link 77 is pivotally coupled between the upper end of the lever 74 and the rear end of the follower 56 so that the follower 56 can be caused to move back and forth by the swinging movement of the lever 74.

Figure 6:
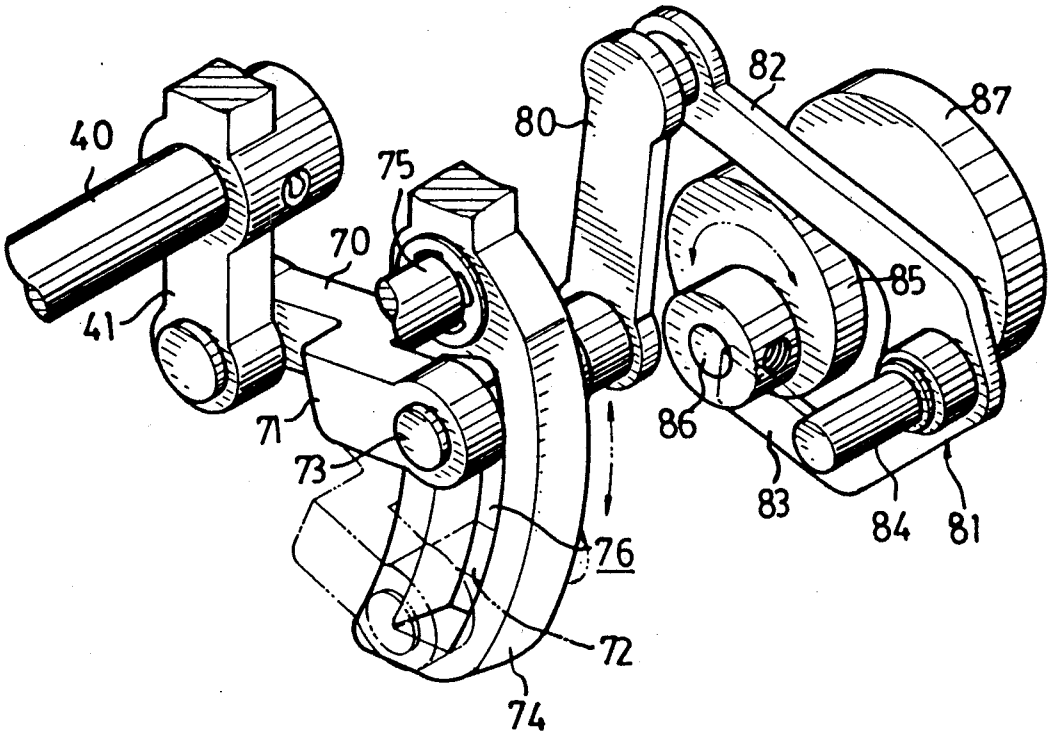
FIG. 6 is a perspective view illustrating an adjusting mechanism for adjusting the differential feeding of cloth.

A lower end of a link 80 is pivotally coupled on the pin 73. A substantially C-shaped follower 81 which includes two legs 82, 83 has a middle portion pivotally supported on a pin 84 which is fixed in the base 12. The front end of the upper leg 82 of the follower 81 is pivotally coupled to the upper end of the link 80. A cam 85 which is fixed on an axle 86 is received between the legs 82, 83 of the follower 81. The axle 86 is rotatably supported in the base 12 and has a knob 87 integrally fixed at the free end thereof. The knob 87 which is reachable from outside of the base 12 (FIG. 1) is provided for rotating the cam 85. As shown in FIG. 6, when the cam 85 rotates, the follower 82 and the link 80 are caused to move up and down so that the block 72 is caused to move up and down along the groove 76 of the lever 74 and so that the distance between the block 72 and the axle 75 can be adjusted.

Figure 8:
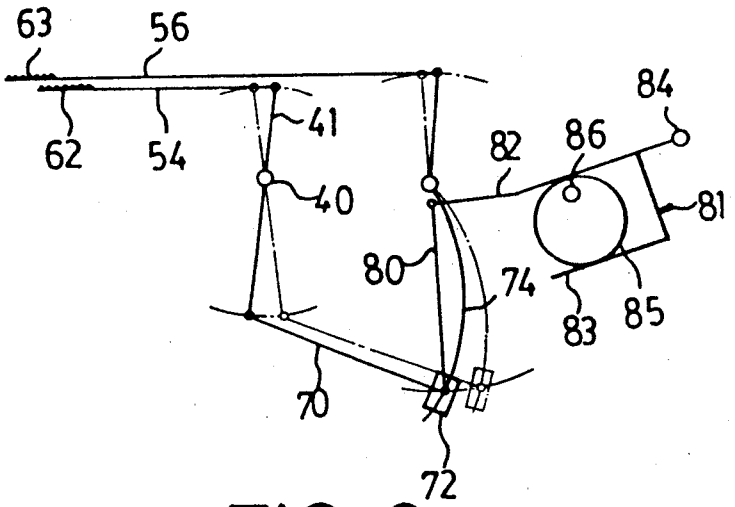
FIGS. 7 and 8 are schematic views illustrating the differential feeding operations.
Figure 7:
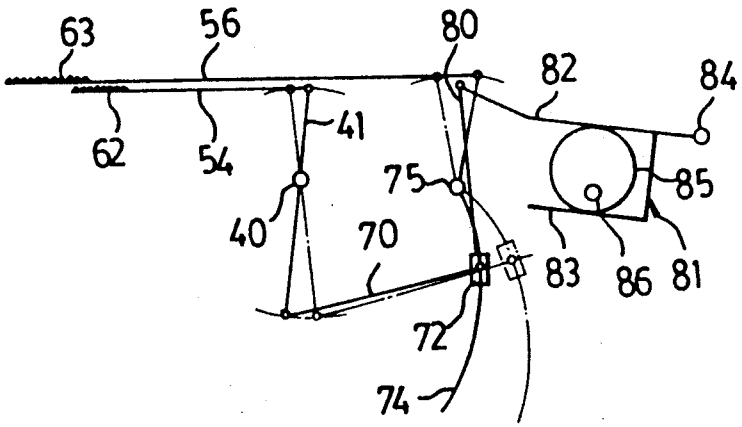

Referring next to FIGS. 7 and 8, the pawl 62 can be caused to move back and forth directly by the swinging movement of the lever 41, and the pawl 63 can be caused to move back and forth by the swinging movement of the lever 41 via the lever 74. As shown in FIG. 7, when the block 72 moves upward to an upper portion of the groove 76, the amplitude of the upper end of the lever 74 will be increased so that the pawl 63 will move further than the pawl 62 and so that the cloth retained by the pawls 62, 63 will be stretched or protracted by the pawls. On the contrary, as shown in FIG. 8, when the block 72 move downward to a lower portion of the groove 76, the amplitude of the upper end of the lever 74 will be decreased so that the pawl 63 moves shorter than that pawl 62 and so that a wrinkle portion will be formed in the cloth between the pawls 62, 63. The wrinkles can thus be automatically formed in the cloth without any manual operations.

Accordingly, the differential feeding apparatus in accordance with the present invention can be provided to form wrinkles in cloth automatically and easily, and elastic articles can also be easily sewed without the manual stretching operations of the elastic articles.

It is to be noted that both knobs 37, 87 can be rotated during sewing operations; i.e., the knobs can be rotated when the spindle 20 and the shaft 40 are rotating. When the knob 37 is rotated, the inclination of the slot 31 can be changed so that the feeding stroke of both pawls 62, 63 can be adjusted during sewing operation, and when the knob 87 is rotated, the block 72 can be guided to slide along the groove 76 of the lever 74 so that the pawls 62, 63 can move relative to each other and so that cloth to be sewed can be fed differentially. The relative displacement between the pawls can also be adjusted during sewing operation.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. A differential feeding apparatus for a sewing machine which has a base for accommodating said differential feeding apparatus, said differential feeding apparatus comprising: a spindle and a shaft rotatably supported in parallel in said base, a middle portion of a first lever being fixed on one end of said shaft, one end of said first lever being coupled to said spindle by a coupling means so that said first lever can be caused to swing by said spindle, a middle portion of a second lever being fixed on the other end of said shaft; a first cam fixed on one end of said spindle and engaged in a first guide which has a square outer shape, said first guide being slidably received in first rectangular openings of a first follower and a second follower so that said first follower and said second follower are caused to move up and down by said first cam; a first pawl being fixed on one end of said first follower, and a second pawl being fixed on one end of said second follower and being aligned with said first pawl; the other end of said first follower being pivotally coupled to one end of said second lever so that said first follower is caused to move back and forth by swinging movement of said second lever; one end of a first link being pivotally coupled to the other end of said second lever, a fork being integrally formed on the other end of said first link, a first block being pivotally coupled between a pair of limbs of said fork by a first pin; a middle portion of a third lever being pivotally supported on a first axle, a groove being formed in a lower portion of said third lever for slidably receiving said first block; an upper end of said third lever being pivotally coupled to the other end of said second follower so that said second follower can be caused to move back and forth by swinging movement of said third lever; a third follower being pivotally supported in said base of said sewing machine and having a leg pivotally coupled to said first pin, a second cam being engaged with said third follower for causing said third follower to move up and down so that said first block can be caused to move up and down along said groove of said third lever, when said first block moves up and down along said groove of said third lever, a distance between said first block and said first axle can be changed and so that an amplitude of said upper end of said third lever can be adjusted, and so that said first pawl can move back and forth relative to said second pawl.

2. A differential feeding apparatus according to claim 1, wherein a middle portion of said third follower is pivotally supported on a second axle; said second cam is engaged between two legs of said third follower so that said third follower can be caused to move up and down by rotation of said second cam; one end of one of said legs of said third follower is pivotally coupled to said first pin by a second link; when said second cam is rotated, said first block is caused to move up and down along said groove of said third lever so that said distance between said first block and said first axle can be changed and so that said amplitude of said upper end of said third lever can be adjusted.

3. A differential feeding apparatus according to claim 2, wherein said second cam is fixed on a third axle which is pivotally supported in said base, a first knob is fixed on one end of said third axle and extends outside of said base so that said second cam can be caused to rotate by rotation of said first knob.

4. A differential feeding apparatus according to claim 1, wherein a notch is formed in said other end of said first follower, a second pin is fixed to said other end of said second follower and is slidably received in said notch of said first follower, said first follower and said second follower are guided to slide relative to each other in a same level by an engagement between said first guide and said first rectangular openings of said first follower and said second follower, and by a slide engagement between said second pin and said notch.

5. A differential feeding apparatus according to claim 1, wherein said coupling means includes a third cam fixed on the other end of said spindle, a second guide having a square outer shape, said third cam is engaged in said second guide, a fourth follower including a second rectangular opening, said second guide is slidably received in said second rectangular opening of said fourth follower so that said fourth follower can be caused to move up and down by said third cam; one end of said fourth follower is pivotally coupled to said one end of said first lever, a second block is pivotally coupled to the other end of said fourth follower and is slidably received in a slot which is formed in one end of a plate, a stub is formed on said one end of said plate and is pivotally supported in said base so that said plate is rotatable about said stub, the other end of said plate is pivotally coupled to a lower end of an arm, a ring portion is integrally formed on an upper end of said arm for receiving a fourth cam which is fixed on a fourth axle, said fourth axle is rotatably supported in said base, a second knob is fixed to one end of said fourth axle and extends outside of said base; when said second knob is rotated, said arm is caused to move up and down by said fourth cam so that said plate is caused to rotate about said stub and so that an inclination of said slot is changed, an amplitude of swinging of said first lever is thus changed so that a feeding stroke of said first pawl and said second pawl can be adjusted.

* * * * *